United States Patent [19]

McGaughey, Jr. et al.

[11] 4,307,970

[45] Dec. 29, 1981

[54] KEY EXTENSION FOR SHORTHAND TYPEWRITING MACHINE

[75] Inventors: Carroll B. McGaughey, Jr., Charlotte, N.C.; John Kreidich, Arlington Heights, Ill.

[73] Assignee: The Hedman Company, Chicago, Ill.

[21] Appl. No.: 154,282

[22] Filed: May 29, 1980

Related U.S. Application Data

[63] Continuation of Ser. No. 747,649, Dec. 6, 1976, abandoned.

[51] Int. Cl.[3] ..... B41J 5/14

[52] U.S. Cl. ..... 400/482; 400/91; 400/272; 400/473

[58] Field of Search ..... 178/21; 84/433; 235/145 R; 400/91-94, 272, 472, 473, 476, 482

[56] References Cited

U.S. PATENT DOCUMENTS

| | | | |
|---|---|---|---|
| 843,032 | 2/1907 | Powell | 400/272 |
| 1,001,370 | 8/1911 | Douthat | 400/272 |
| 1,080,424 | 12/1913 | Davis | 400/496 X |
| 1,267,356 | 5/1918 | Barr | 400/418 |
| 1,293,739 | 2/1919 | Edwards | 400/92 |
| 1,676,809 | 7/1928 | Uhlig | 400/681 |
| 2,399,769 | 5/1946 | Sweeney | 400/93 |
| 2,776,738 | 1/1957 | Segui | 400/91 X |
| 2,841,268 | 7/1958 | Cantonwine | 400/476 |
| 2,958,408 | 11/1960 | Cantonwine | 400/472 |

*Primary Examiner*—Paul T. Sewell

*Attorney, Agent, or Firm*—Dithmar, Stotland, Stratman & Levy

[57] ABSTRACT

A shorthand typewriting machine includes a standard keyboard having two rows of upper keys respectively corresponding to consonant characters and an asterisk character all positioned for operation by the fingers, and a lower row of keys respectively corresponding to vowel characters and disposed for operation by the thumbs. An extension key is attachable to the asterisk key for ganged operation therewith, the extension key being disposed in use in the lower row of keys for operation by the thumbs in conjunction with any one or more of the vowel keys for readily printing an asterisk character in conjunction with a vowel character to indicate the long sound thereof. A retractable extension key is shown which can be retracted when not in use and a detachable extension key is shown which can be removed completely from the asterisk key when not in use.

3 Claims, 10 Drawing Figures

FIG. 6
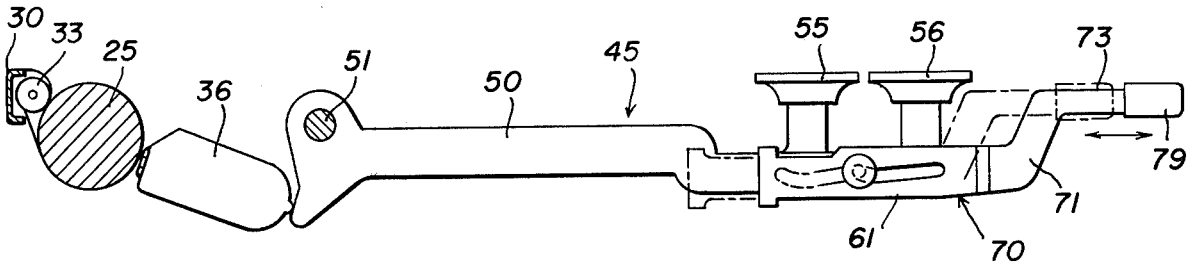
FIG. 7
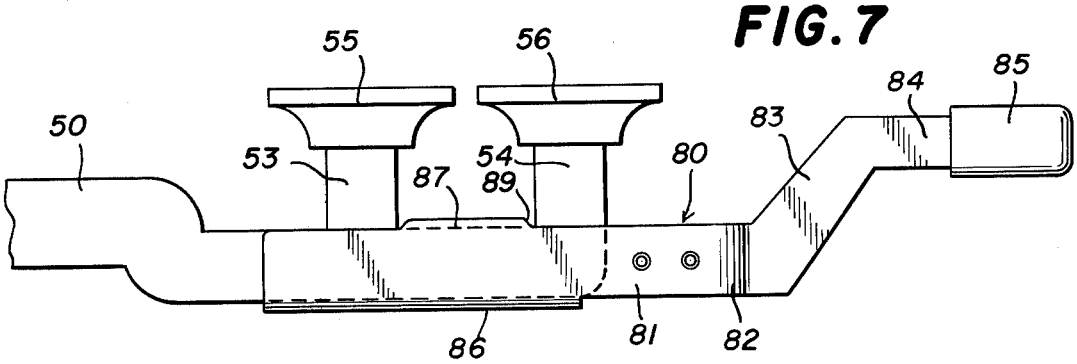
FIG. 8
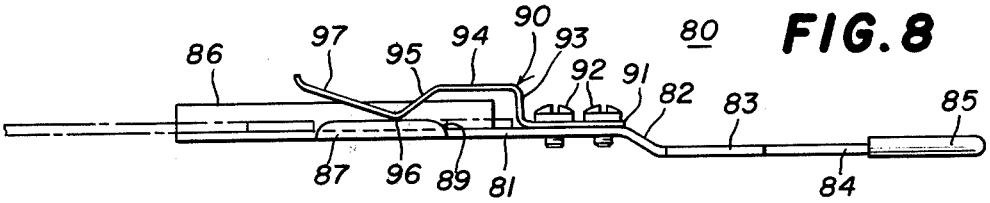
FIG. 9
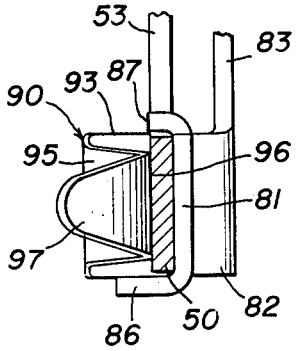
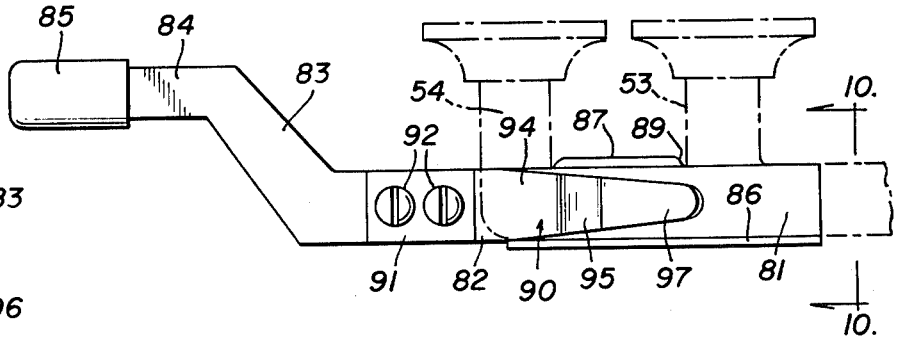
FIG. 10

KEY EXTENSION FOR SHORTHAND TYPEWRITING MACHINE

This is a continuation of application Ser. No. 747,649, filed Dec. 6, 1976, abandoned.

BACKGROUND OF THE INVENTION

This invention relates to shorthand typewriting machines by means of which syllables or words may respectively be represented on successive lines of a paper strip by one or more typed characters printed simultaneously.

In shorthand typewriting machines which are now in general use there is provided a plurality of upper keys representing consonant characters arranged in a double row across the keyboard to be operated by the fingers of both hands and a plurality of lower keys at the front of the keyboard representing vowel characters to be operated by the thumbs. All of the consonant characters are not included, certain ones being represented by combinations of certain others in accordance with the code used. A shift key is provided to shift the type bars so that numerals may be printed when this shift key is operated with certain of the consonant keys. Typically, one of the upper keys near the center of the upper double row of keys represents an asterisk character.

The basic keyboard arrangement of the shorthand typewriting machine is as traditional and fixed as that of a typewriter. Certain typewriter manufacturers add small features such as margin settings, tabulating convenience, rearrangement of certain symbol keys or accessibility of special symbols. But the basic alphabetic keyboard arrangement is so locked in tradition that an attempt to change it is virtually precluded, since only persons trained on the new keyboard would be able to operate that machine, and they would be able to operate no other.

In this basic keyboard arrangement, there is no means to differentiate between variations of vowel sounds. In original stenotyping systems, the designation of long versus short vowel sounds was deemed unnecessary. The two sounds were, in general, keyed on the shorthand typewriting machine in identical manner. The operator depended upon the judgment of the transcriber (himself or someone else) to interpret the "context" of the material to determine whether the noted word was intended to be, for example, "tap" or "tape". In recent years two factors have raised serious questions about the adequacy of this system;

(1) In certain cases it is more advantageous for someone other than the original recorder to transcribe the notes, and that person, denied the opportunity of hearing the original dictation or dialogue, frequently is an unreliable judge of the intent of the apparent "context";

(2) Computer-assisted transcription is becoming more and more promising, but the computer is not capable of judgment, only of determining an either/or decision. Thus, faced with the notation "TAP", the computer cannot examine the logic of the sentence structure to determine whether "tap" or "tape" was intended.

Efforts have also been made to differentiate between the long and short sounds of vowels by modifying the basic keyboard of the shorthand typewriting machine to add an additional character to be printed with the vowel to indicate the long sound thereof. Such an arrangement is disclosed in U.S. Pat. No. 2,399,769, issued to J. L. Sweeney on May 7, 1946. Sweeney discloses several embodiments of his system for adding a character representing a diacritical mark to the standard keyboard for printing with a vowel to indicate the long sound thereof.

Every one of Sweeney's embodiments involves some change in the basic keyboard arrangement, so that one or more of the standard characters can no longer be printed, or can only be printed by utilizing a new stroke or combination of strokes different from that utilized on the standard keyboard to print the character. For example, in the Sweeney embodiment which involves the least change of the standard keyboard, the asterisk key is modified so as to print the diacritical mark when the key is struck by itself, and to print an asterisk only when the key is struck in combination with the shift key.

Furthermore, in all of the Sweeney embodiments, the row of vowel keys has been moved further away from the rows of consonant keys to accommodate placement therebetween of the diacritical mark key or keys which Sweeney has added to the standard machine. This shift in the vowel key position would necessitate a significant adjustment for an operator trained on a standard keyboard.

Thus, as a short/long vowel designation has been increasingly demanded by certain stenotypists, various proposals have been advanced to distinguish the short/long difference without altering the basic and traditional keyboard (which would alienate those trained to its use).

The system for stenotype differentiation most frequently accepted is based on the concept that there are four vowel keys on the machine. Two (A and O) are operated by the left thumb either individually or simultaneously, and two (E and U) are operated by the right thumb either snugly or simultaneously. The sound for "I" is designated by the EU characters printed simultaneously. Certain other combinations of the vowel keys are also utilized in this system to represent other sounds. When the need for distinguishing long/short vowels becomes a requirement, the traditional approach has been to utilize the unadorned vowel symbol (A, E, O, U or EU for "I") to represent any sound of the vowel other than the long sound, and to create some combination of the remaining vowel keys (not already used for a recognized sound such as EU) to designate the long vowel. Thus:

"AI" is for a long A.
"AOE" is for a long E.
"AOI" is for a long I.
"OE" is for a long O.
"AO" is for a long U.

This method has proven difficult for operators to comprehend when reading, difficult to master in reflexive keying, and extremely difficult for a person trained in the non-distinguishing system to adopt.

SUMMARY OF THE INVENTION

The present invention provides a shorthand typewriting machine which permits differentiation between the long and short sounds of vowels in a simple, yet clear and unambiguous manner.

It is an important feature of the present invention to provide a shorthand typewriting machine which permits differentiation between the long and short sounds of vowels without alteration of the basic and traditional keyboard, so that all characters can still be printed with precisely the same strokes as are used to print them on the basic and traditional machine.

It is another feature of this invention that differentiation between the long and short sounds of vowels is accomplished by the use of only the characters which appear on the basic and traditional keyboard, without the necessity for adding any additional characters.

Another important feature of this invention is that one of the keys normally operated by the fingers is modified so that it can also be operated by the thumbs and be struck simultaneously with one or more of the vowel characters to indicate the long sound thereof.

It is still another feature of this invention that the key for the asterisk character can be operated in conjunction with a vowel character, so that the asterisk character can be used unambiguously to designate the long vowel sound.

Another feature of this invention is that the key modification can be selectively employed or not employed as desired by the operator.

It is an important object of the present invention to accomplish these advantages by providing a shorthand typewriting machine which includes apparatus to facilitate utilizing one of the characters in the upper rows of keys in combination with a vowel character to indicate the long sound thereof, without modifying the basic keyboard or adding any new characters thereto.

In connection with the foregoing object, it is another object of this invention to provide apparatus for permitting one of the characters normally operated with the fingers to be also operated with the thumbs in conjunction with one or more of the vowel characters.

Still another object of this invention is to provide a modified asterisk key having two portions respectively disposed in the upper and lower rows of keys so that it can be operated either with the fingers or the thumbs.

It is another object of this invention to provide an extension apparatus which can be added to the asterisk key of a standard shorthand typewriting machine to permit that key to be operated by the thumbs as well as the fingers.

Still another object of this invention is to provide an extension apparatus of the type set forth which is coupled to the asterisk key for movement between a retracted position and an extended position.

It is another object of this invention to provide an extension apparatus of the type set forth which is removably mountable on the asterisk key.

It is a general object of this invention to provide the foregoing advantages by providing a shorthand typewriting machine comprising a plurality of first keys respectively representing consonant characters and an asterisk character and arranged to be operated by the fingers, a plurality of second keys respectively representing vowel characters and arranged to be operated by the thumbs, printing mechanism coupled to the first and second keys for printing each character when the key representing that character is operated, and an extension key coupled to the one of the first keys which represents the asterisk character for ganged operation therewith, the extension key being so shaped and positioned that it may be operated by a thumb together with any one or more of the second keys thereby causing the asterisk character to be printed in conjunction with any one or more of the vowel characters to indicate the long sound thereof.

Further features of the invention pertain to the particular arrangement of the parts of the extension apparatus and shorthand typewriting machine whereby the above-outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

FIG. 6 is a view similar to FIG. 2, illustrating an extension key constructed in accordance with a second embodiment of the present invention;

FIG. 7 is a further enlarged fragmentary side elevational view of the front portion of the asterisk key illustrated in FIG. 2, having attached thereto an extension key constructed in accordance with and embodying the features of a third embodiment of the present invention;

FIG. 8 is a top plan view of the extension key illustrated in FIG. 7;

FIG. 9 is a side elevational view of the extension key illustrated in FIG. 7, as viewed from the opposite side thereof; and FIG. 10 is a further enlarged fragmentary end elevational view of the extension key illustrated in FIG. 9, as viewed from the right-hand end thereof.

DESCRIPTION OF THE PREFERRED EMBODIMENTS

Figure 1:
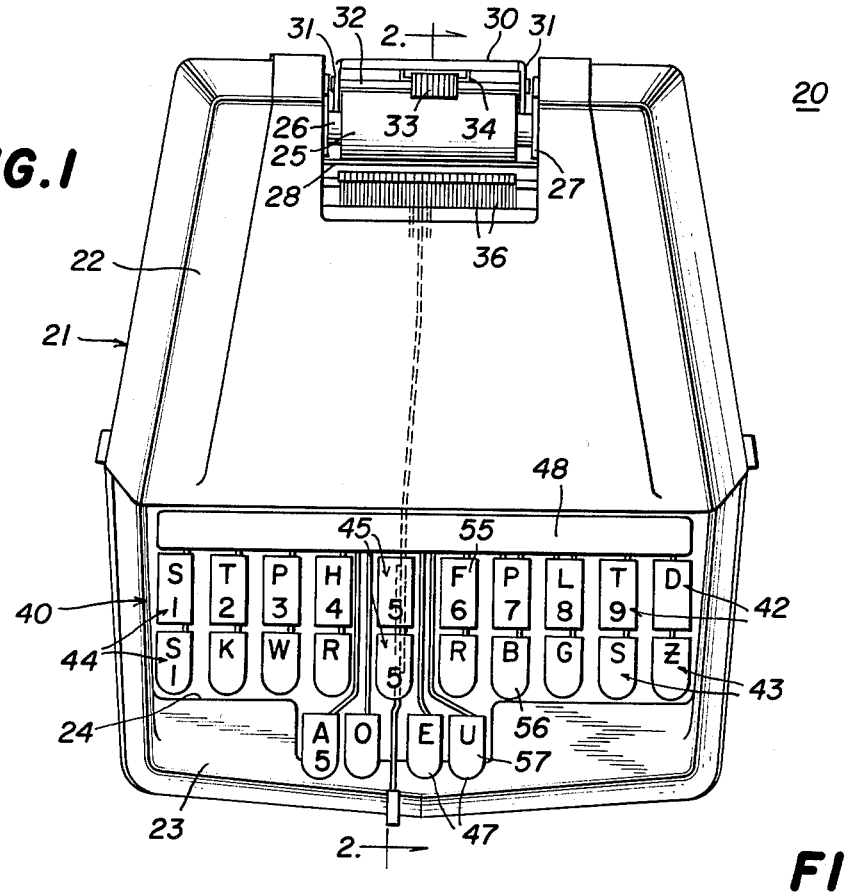
FIG. 1 is a top plan view of a standard shorthand typewriting machine including key extension apparatus constructed in accordance with and embodying the features of the present invention.

Referring now to FIG. 1 of the drawings, there is illustrated a shorthand typewriting machine, generally designated by the numeral 20, which is substantially of standard construction, but includes the key extension apparatus constructed in accordance with and embodying the features of the present invention. The shorthand typewriting machine 20 includes a housing 21 which is preferably formed of metal, and which includes a top cover 22 hingedly coupled to the remainder of the housing 21 at the rear end thereof, and liftable to expose the printing mechanism of the shorthand typewriting machine 20. The upper front portion of the housing 21 comprises an apron 23 having a cut-out portion 24 formed therein to accommodate a keyboard, generally designated by the numeral 40.

The printing mechanism of the shorthand typewriting machine includes a platen roll 25 having hub shafts 26 which are respectively journaled in bearings 27 for rotational movement of the platen roll 25. Extending in front of the platen roll 25 parallel to the axis of rotation thereof and spaced a predetermined slight distance from the outer perimeter thereof is a reach of an inked ribbon 28, the opposite ends of which are respectively connected to suitable supply and take-up spools (not shown) in a well-known manner. Disposed at the rear of the platen roll 25 substantially parallel to the axis thereof is a bracket 30 provided with bracket arms 31 which are pivotally mounted beneath the platen roll 25. Extending between the bracket arms 31 is a spindle 32 having rotatably mounted thereon centrally thereof a grooved feed roll 33, the bracket arms 31 being coupled to suitable spring means (not shown) for resiliently urging the feed roll 33 toward engagement with the platen roll 25. Preferably, the feed roll 33 is centered with respect to the platen roll 25 by means of positioning tabs 34 on the bracket 30.

The printing mechanism operates to print upon a continuous strip of paper tape 35, a supply of which is preferably provided in zigzag folds forming a stack housed in a suitable magazine (not shown) beneath the printing mechanism, from which the tape 35 may be withdrawn as the machine 20 operates. More particularly, referring also to FIG. 2 of the drawings, the tape 35 is fed from the magazine upwardly between the inked ribbon 28 and the front of the platen roll 25, and thence around the top of the platen roll 25 and beneath the feed roll 33, so that the tape 35 is pinched between the feed roll 33 and the platen roll 25. As the machine operates, the platen roll 25 is rotated by suitable mechanism (not shown) to feed the printed tape 35 out from the rear of the machine 20, in a well-known manner.

The printing of characters on the tape 35 is accomplished by means of a plurality of type bars 36, respectively corresponding to keys on the keyboard 40, the type bars 36 being arranged side by side in a row for parallel reciprocating movement so that each prints only in a predetermined position on the tape 35. Each type bar 36 is provided at the front end thereof with a type face 37 which, in operation, engages the inked ribbon 28 and pushes it against the portion of the tape 35 wrapped around the platen roll 25 for imprinting a character on the tape 35.

The keyboard 40 includes a plurality of upper keys arranged in two parallel rows, including a plurality of rear keys 42 arranged in a rear row and a plurality of front keys 43 arranged in a front row, the front keys 43 being respectively aligned with corresponding rear keys 42 to form pairs of keys. The pair of keys at the left end of the front and rear rows, as viewed in FIG. 1, are preferably ganged together and operate as a single key, as at 44. Similarly, the fifth pair of keys from the left end of the front and rear rows are also ganged together to operate as a single key as at 45. There are ten keys in each of the front and rear rows of the upper keys 42 and 43. Four lower keys 47 are arranged in a row parallel to the rows of upper keys 42 and 43, but displaced vertically downwardly therebelow and horizontally forwardly thereof. In the standard keyboard 40, the lower keys 47 are arranged symmetrically with respect to the ganged key 45, the gap between the middle two of the lower keys 47 being substantially greater than the gaps between each of those middle keys and the adjacent outer ones of the lower keys 47.

The keyboard 40 also includes an elongated space key 48 disposed just behind the rear row of upper keys 42 and extending the entire length thereof, the space key 48 serving to advance the tape feed without imprinting any characters thereon. The key 48 may also operate as a shift key which serves the same purpose as a shift key on a typewriter. More particularly, each of the type bars 36 may carry two separate type faces 37 thereon, one of which will print when the corresponding key is operated by itself, and the other of which will print when the corresponding key is operated simultaneously with the shift key 48.

In the standard keyboard 40, the upper keys 42 and 43 respectively correspond to consonant characters, with the exception of the ganged key 45 which corresponds to an abstract character which is typically an asterisk character but could be any non-alphanumeric symbol, while the lower keys 47 respectively correspond to vowel characters. In FIG. 1, there is illustrated on each of the keys 42 through 45 and 47 the character or characters to which that key corresponds. Where more than one character is shown on a key, the upper character is the one which is imprinted when the key is operated by itself, and the lower character is the one which is imprinted when the key is operated in combination with the shift key 48. Where only one character is illustrated on a key, that character will be printed regardless of whether the key is operated by itself or in combination with the shift key 48. In use, the upper keys 44 and 45 and the keys 42 and 43 therebetween are to be operated with the fingers of the left hand, while the remainder of the upper keys 42 and 43 are to be operated with the fingers of the right hand; the left-hand two of the lower keys 47 are to be operated with the thumb of the left hand while the right-hand two of the lower keys 47 are to be operated with the thumb of the right hand. The asterisk key 45 may be operated with the forefinger of either hand, depending upon the convenience of stroking.

Figure 2:
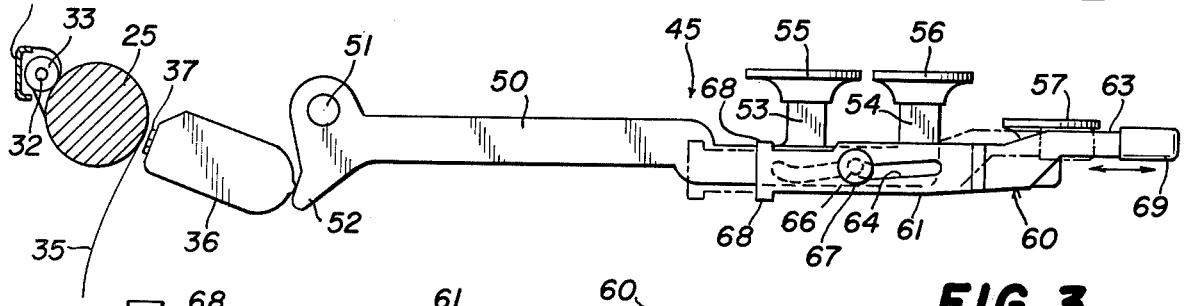
FIG. 2 is an enlarged view in vertical section taken along the line 2—2 in FIG. 1, and illustrating the asterisk key having attached thereto an extension key constructed in accordance with a first embodiment of the invention, and illustrating the extended and retracted positions of the extension key.

Each of the keys 42 through 45 and 47 is coupled to the corresponding type bar 36 by a lever bar 50, the lever bar 50 for the ganged asterisk key 45 being illustrated in FIG. 2 of the drawings. The lever bar 50 is pivotally mounted adjacent to one end thereof on a pivot pin 51 and includes a finger 52 which is disposed in engagement with the corresponding type bar 36, the type bar 36 and lever bar 50 being preferably biased by suitable means (not shown) toward counterclockwise rotation of the lever bar 50 about the pivot pin 51, as viewed in FIG. 2. The lever bar 50 is provided at the front end thereof with two upstanding posts 53 and 54 arranged in tandem and respectively carrying at the upper ends thereof key tabs 55 and 56, the upper surfaces of which are arranged in a substantially coplanar relationship. The asterisk key 45 is operated by contacting the key tab 55 or 56 with a finger and depressing the asterisk key 45, thereby rotating it in a clockwise direction about the pivot pin 51 and urging the type bar 36 toward the platen roll 25 for imprinting the asterisk character on the tape 35 in standard fashion.

It will be understood that each of the upper keys 42 includes a post 53 and key tab 55, while each of the upper keys 43 includes a post 54 and key tab 56, the key tabs of all of the upper keys 42 and 43 being disposed in a substantially coplanar relationship. Similarly, it will be appreciated that the lever bar for each of the lower keys 47 is substantially the same as the lever bar 50 except that it extends slightly further toward the front of the machine 20, and carries a key tab 57, the upper surfaces of the key tabs 57 all being arranged in substantially coplanar relationship and disposed a predetermined distance below the plane of the key tabs 55 and 56.

Figure 3:
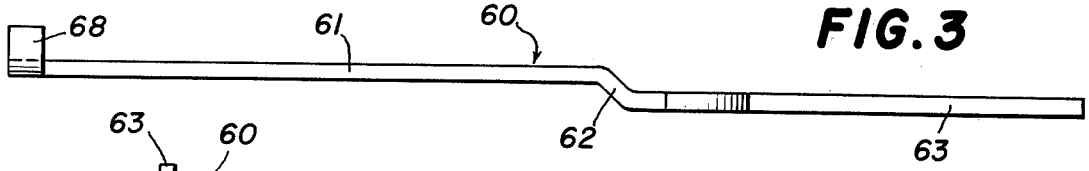
FIG. 3 is a further enlarged top plan view of the extension key illustrated in FIG. 2.
Figure 5:
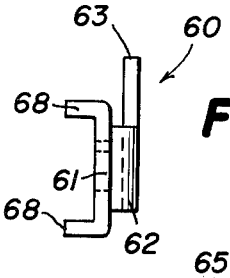
FIG. 5 is an end elevational view of the extension key illustrated in FIG. 4, as viewed from the left-hand end thereof.
Figure 4:
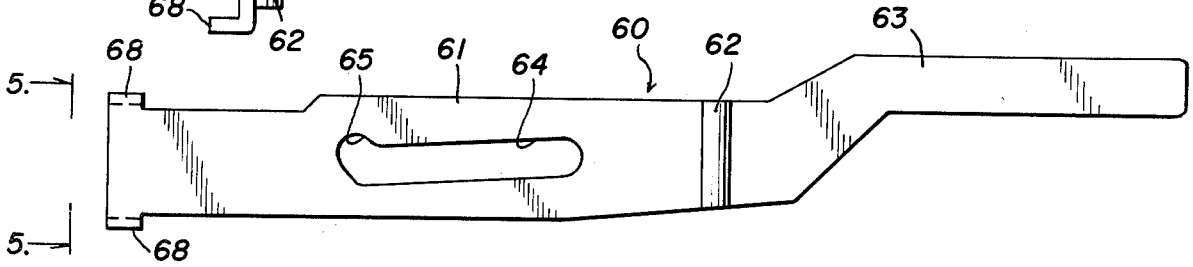
FIG. 4 is a side elevational view of the extension key illustrated in FIG. 3.

Referring now also to FIGS. 3 through 5 of the drawings, there is illustrated an extension key, generally designated by the numeral 60, constructed in accordance with and embodying the features of a first embodiment of the present invention. The extension key 60, which is preferably formed of metal, is adapted to be connected to the asterisk key 45, and includes an elongated flat arm 61, integrally connected at one end thereof to a laterally offset finger 63 by means of an elbow portion 62. The arm 61 is provided with an elongated slot 64 therethrough extending generally longitudinally thereof, the slot 64 being slightly inclined with respect to the longitudinal axis of the arm 61 and provided at one end thereof with a lobe 65. The slot 64 is dimensioned to receive therethrough one end of a pin 66 which is received through a complementary opening formed in the lever bar 50 of the asterisk key 45 between the posts 53 and 54, whereby the arm 61 may be mounted to the lever bar 50 in parallel back-to-back relationship therewith. Preferably, suitable clips 67 are provided at each end of the pin 66 for preventing withdrawal thereof from the slot 64 or the opening in the lever bar 50. At the end thereof opposite the finger 63, the arm 61 is provided with a pair of retaining flanges 68 which respectively extend from the arm 61 substantially normal thereto along the upper and lower edges thereof for respectively engaging the upper and lower edges of the lever bar 50. If desired, a finger grip 69 formed of rubber, plastic or the like may be carried by the finger 63 at the distal end thereof.

In operation, the pin 66 is so dimensioned that it is slidable with respect to the slot 64, whereby the extension key 60 is slidably movable with respect to the lever bar 50 longitudinally thereof between an extended position illustrated in solid line in FIG. 2, and a retracted position illustrated in broken line in FIG. 2, the extent of this sliding movement being limited by the length of the slot 64. The slight inclination of the slot 64 imposes a slight frictional drag, so that the extension key 60 must be positively moved between its extended and retracted positions and will not accidentally slip back and forth therebetween. When the extension key 60 is disposed in its extended position, the pin 66 is disposed in the lobe 65 of the slot 64 for lightly holding the extension key 60 in its extended position. The grip member 69 serves to facilitate grasping of the finger 63 for moving the extension key 60 between its extended and retracted positions. The retaining flanges 68 cooperate with the lever bar 50 to prevent pivotal movement of the extension key 60 with respect to the pin 66.

Because the asterisk key 45 is centered with respect to the row of vowel keys 47, the arm 61 and finger 63 of the extension key 60 extend transversely of the row of keys 47 into the gap between the "O" and "E" keys, in a position where it can be operated by either thumb of the operator, the finger 63 being disposed approximately at the level of the key tabs 57, and the lateral offset of the finger 63 being sufficient to substantially center it between the "O" and "E" keys. In the extended position of the extension key 60, the finger 63 extends forwardly well beyond the row of lower keys 47 so that the thumbs must be moved forwardly slightly to operate the extension key 60, whereby the extension key 60 may be clearly distinguishable by touch from the vowel keys 47. It can be seen that the extension key 60 is ganged together with the asterisk key 45 so that depression of the extension key 60 by the thumb of an operator serves to imprint an asterisk character on the tape 35.

This arrangement affords a uniquely simple way of differentiating between the long and short sounds of vowels with the shorthand typewriting machine 20. Traditionally, the asterisk character is utilized for only two purposes: (1) a single stroke of the asterisk character indicates a mistake immediately preceding and the operator's intent to correct the mistake in the entry which follows; and (2) a two-stroke entry of the asterisk character indicates the beginning of a new paragraph. In standard usage, the asterisk character is never struck simultaneously with a vowel character and, therefore, the asterisk character is available for use with the vowel characters unambiguously to indicate the long sounds thereof.

The present invention permits the utilization of this code concept by making the asterisk key 45 readily accessible by the thumbs. This is necessary because the fingers will normally be otherwise occupied in stroking the consonant characters for the particular outline being typed. The extension key 60 of the present invention makes the asterisk key 45 accessible to either thumb, without interfering with the normal accessibility of the asterisk key 45 to the index fingers, and without interfering with the normal operation of either the remaining vowel keys 47 or the consonant keys 42 and 43. Thus, an operator trained on a standard keyboard can, with a minimal adjustment, readily adapt to the coding scheme whereby an asterisk is utilized with a vowel character to indicate the long sound thereof. Even more importantly, when the tape must be transcribed by someone other than the operator, the transcriber can much more easily adapt to this coding scheme for differentiating between the long and short sounds of vowels, than to the previously-used code wherein a combination of the vowel with other vowel characters is utilized to indicate the long sound thereof.

By way of example, the coding scheme for differentiating between the long and short sounds of vowels utilized with the present invention is as follows:

"A*" represents the long sound of A.
"A" represents all other sounds of A.
"*E" represents the long sound of E.
"E" represents all other sounds of E.
"*EU" represents the long sound of I.
"EU" represents all other sounds of I.
"O*" represents the long sound of O.
"O" represents all other sounds of O.
"*U" represents the long sound of U.
"U" represents all other sounds of U.

It is another important feature of the present invention that an operator who is trained on the standard keyboard need not adopt the modified coding scheme of the present invention. The use of the present invention is made optional by the fact that the extension key 60 may be moved to its retracted position when not in use, so that the operator can use any other standard coding scheme he wishes for differentiating the long and short sounds of vowels. Furthermore, by reason of the fact that the extension key 60 is in the form of an add-on to the standard machine, it can be utilized to simply and easily modify any existing standard machine, whereby it is not necessary to purchase a new machine or to have major rebuilding of an existing machine in order to utilize the present invention. In addition, the machine 20 is typically provided with a carrying case in which the machine snugly fits, and the retractability of the extension key 60 prevents interference with closure of the carrying case which might occur when the extension key 60 is in its extended position.

Referring now also to FIG. 6 of the drawings, there is illustrated an alternative embodiment, generally designated by the numeral 70, of the extension key of the present invention. The extension key 70 includes an arm 61 which is substantially identical in construction to the arm 61 of the extension key 60 and is attached to the lever bar 50 of the asterisk key 45 in the same manner as was described above with respect to the extension key 60. The only difference between the extension keys 60 and 70 is that the latter has a finger 73 which includes an elongated riser portion 71 which connects it to the arm 61 so that the finger 73 extends upwardly well above the plane of the key tabs 57 of the lower vowel keys 47. The extension key 70 is movable between extended and retracted positions in exactly the same manner as was described above with respect to the extension key 60, and the finger 73 may be provided with a gripping member 79 at the distal end thereof.

It is recognized that with the extension key 60, it might be possible to accidentally depress the key finger 63 together with the "O" or "E" key. With the modified extension key 70 this possibility is minimized, since the operator's thumb will rest against the side of the elevated key finger 73 when the thumbs are in their ready position on the key tabs 57. Thus, the operator will readily be able to locate the extension key finger 73 by touch at all times, and it will not be possible for his thumb to accidentally slide over and depress the key finger 73, since the thumb must be lifted well above the level of the key tabs 57 in order to engage the top of the key tab 73.

Referring now also to FIGS. 7 through 10 of the drawings, there is illustrated another embodiment, generally designated by the numeral 80, of the extension key of the present invention. The extension key 80, which is preferably formed of metal, is adapted to be releasably or removably mounted on the asterisk key 45 and includes an elongated flat arm 81, integral at one end thereof with an elbow portion 82 which is in turn integral with a laterally offset riser portion 83 which terminates in a forwardly extending finger 84. The distal end of the finger 84 may be provided with a covering grip 85 of rubber, plastic or the like. Integral with the arm 81 along the lower edge thereof and extending laterally therefrom substantially normal thereto is a lower retaining flange 86. Integral with the upper edge of the arm 81 and extending laterally therefrom substantially parallel to the lower retaining flange 86 is an upper retaining flange or stop member 87, the forward and rearward ends of which are mounted as at 89. The lower retaining flange 86 is longer and wider than the upper retaining flange 87, the latter having a dimension only slightly less than the space between the posts 53 and 54 of the lever bar 50 of the asterisk key 45.

There is also provided an attachment spring clip, generally designated by the numeral 90, which is preferably formed of flat spring steel and includes a straight anchor portion 91 which is disposed in parallel back-to-back relationship with the portion of the arm 81 between the rear edge of the lower retaining flange 86 and the elbow 82 on the side of the arm 81 toward which the flanges 86 and 87 extend, the anchor portion 91 being secured to the arm 81 by means of screws 92. Integral with the anchor portion 91 and extending therefrom substantially normal thereto in the direction of the flanges 86 and 87 is a flange 93 which is in turn integral with a flat flange 94 substantially parallel to the anchor portion 91 and offset laterally therefrom. Integral with the flange 94 and inclined with respect thereto and extending inwardly toward the arm 81 is a flange 85, which is in turn joined at an elbow 96 to a tongue portion 97 which is inclined outwardly away from the arm 81. The spring clip 90 is so dimensioned and preformed that the elbow 96 is resiliently urged toward engagement with the adjacent side surface of the arm 81 for cooperation therewith to form a pair of clamping members.

In operation, the extension key 80 is slid onto the lever bar 50 of the asterisk key 45 by bringing the lower retaining flange 86 into engagement with the bottom edge of the lever bar 50 and then sliding the arm 81 rearwardly along the lever bar 50. The lever bar 50 is guided by the tongue 97 between the elbow 96 of the spring clip 90 and the arm 81 and resiliently forces the spring clip 90 away from the arm 81 to accommodate passage therebetween of the lever bar 50 and to accommodate cammed movement of the upper retaining flange 87 past the front post 54 of the lever bar 50. When the upper retaining flange 87 has passed the post 54, it snaps into place between the posts 53 and 54 to a mounting position overlying the upper edge of the lever bar 50. In this mounted configuration illustrated in the drawings, the lever bar 50 is snugly clamped between the arm 81 and the spring clip 90, and is also closely constrained between the upper and lower retaining flanges 86 and 87. The retaining flanges 86 and 87 cooperate to prevent any pivotal up and down movement of the extension key 80 with respect to the asterisk key 45, while the upper retaining flange 87 cooperates with the posts 53 and 54 to inhibit forward or rearward sliding motion of the extension key 80 from the mounted configuration thereof. Thus, the forces applied to the extension key 80 by an operator in normal use of the machine 20 will not serve to dislodge the extension key 80 from its mounted configuration.

However, when it is desired to remove the extension key 80 from the asterisk key 45, an outward or forward pull on the finger 84 with a moderate force will serve to cam the upper retaining flange 87 along the side surface of the post 54, thereby deflecting the spring clip 90 away from the arm 81 and permitting passage of the upper retaining flange 87 past the forward post 54 for sliding the extension key 80 off the lever bar 50 of the asterisk key 45. For this purpose, it will be noted that the rounded forward and rearward edges 89 of the upper retaining flange 87 facilitate the camming movement past the post 54.

Preferably, when the extension key 80 is mounted in its mounted configuration on the asterisk key 45, the finger 84 is disposed at a level well above the plane of the key tabs 57, just as in the case of the extension key 70 described above, and for the same reasons. The virtue of the removable extension key 80 is that it can be mounted or removed by an operator at will without any modification whatsoever to the asterisk key 45 and without the use of any tools.

While in the present invention the extension keys 60, 70 and 80 have been disclosed as adaptable for mounting on the asterisk key 45 for effecting use of the unique code of the present invention for differentiating between the long and short sounds of vowels, it will be appreciated that, if desired, the extension keys 60, 70 or 80 could be mounted on any of the upper keys 42 through 45 by appropriate modification of the shape of the extension key. And while, in the preferred embodiment, the extension key 60 is coupled to the asterisk key for using the asterisk to indicate the long sound of vowels, it will be understood that, in general, the extension key 60 provides an extra key available to the thumbs for use in conjunction with any desired combinations of consonant and/or vowel characters, thus providing a potential for a whole code of "arbitrary" notations for words or phrases which do not conflict with the standard interpretation of those notations.

Furthermore, while the extension keys of the present invention have been disclosed as preferably being constructed of metal, it will be understood that they could be constructed of plastic or any other suitable material.

Also, while the present invention has been disclosed for use with an entirely mechanical shorthand typewriting machine, it will be appreciated that the code of the present invention, whereby an asterisk is utilized in conjunction with a vowel to indicate the long sound thereof, could as well be utilized with electronic shorthand machines.

Finally, it is recognized that the key tabs 55 through 57 could, instead of being arranged in substantially coplanar arrays, be inclined with respect to the horizontal, if desired, to enhance accurate accessibility by the fingers and thumbs of the user. For example, the lower key tabs 57 could be canted downwardly and away from the longitudinal center plane of the machine 20 (the section plane of FIG. 2) in order to increase the space between the "0" and "E" keys.

From the foregoing, it can be seen that there has been provided an improved shorthand typewriting machine which permits simple and unambiguous differentiation between the long and short sounds of vowels without any alteration in the basic standard keyboard arrangement.

There has also been provided an improved shorthand typewriting machine which permits unambiguous differentiation of the long and short sounds of vowels without adding any additional characters to the standard keyboard.

More particularly, there has been provided an improved shorthand typewriting machine, wherein the asterisk key includes two portions respectively operable by the fingers and the thumbs of an operator so that the asterisk character can be printed in conjunction with any one or more of the vowel characters to designate the long sound thereof.

There has, more specifically, been provided an extension key which can be added to the asterisk key of a standard shorthand typewriting machine for ganged operation therewith so as to make the asterisk key accessible to either thumb of the operator.

There has also been provided an extension key of the character described, which is retractable when not in use. In addition, an extension key of the type set forth has been provided which is completely removable from the asterisk key when not in use.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. Extension apparatus for addition to and use with a key of a standard shorthand typewriting machine having a keyboard on which first keys are arranged for operation by the fingers and second keys are arranged for operation by the thumbs, said extension apparatus comprising an extension key, and means for coupling said extension key to a selected one of the first keys for ganged operation therewith and without alteration of any other key, said coupling means accommodating longitudinal sliding movement of said extension key with respect to the selected one of the first keys between a retracted position for storage when not in use and an extended position disposed adjacent to the second keys for operation by the thumbs in conjunction with any one or more of the second keys.

2. Extension apparatus for addition to and use with a key of a standard shorthand typewriting machine having a keyboard on which first keys are arranged for operation by the fingers and second keys are arranged for operation by the thumbs, said extension apparatus comprising an extension key, and means for coupling said extension key to a selected one of the first keys for ganged operation therewith and without alteration of any other key, said coupling means accommodating movement of said extension key with respect to the one first key between a retracted position for storage when not in use and an extended position disposed adjacent to the second keys for operation by the thumbs in conjunction with any one or more of the second keys, said coupling means including an elongated coupling arm connected to said extension key and having an elongated slot therein extending generally longitudinally thereof, and a pin fixedly secured to the selected one of the first keys and receivable in said slot for sliding movement therealong as said extension key is moved between the retracted and extended positions thereof.

3. The extension apparatus set forth in claim 2, wherein said slot has a lobe portion at one end thereof for receiving said pin therein when said extension key is in the extended position thereof thereby to hold said extension key in its extended position.

* * * * *